United States Patent [19]

Moriyama et al.

[11] 4,171,957

[45] Oct. 23, 1979

[54] METHOD FOR STABILIZING A MIXED FUEL

[75] Inventors: Noboru Moriyama; Masaaki Tsuchihashi, both of Wakayama, Japan

[73] Assignee: Kao Soap Co., Ltd., Tokyo, Japan

[21] Appl. No.: 894,422

[22] Filed: Apr. 7, 1978

[30] Foreign Application Priority Data

Apr. 14, 1977 [JP] Japan ..... 52-42962

[51] Int. Cl.[2] ..... C10L 1/32

[52] U.S. Cl. ..... 44/51

[58] Field of Search ..... 44/51; 252/353, 256

[56] References Cited

U.S. PATENT DOCUMENTS

| | | | |
|---|---|---|---|
| 1,390,230 | 9/1921 | Bates | 44/51 |
| 2,718,498 | 9/1955 | Salathiel | 252/353 |
| 3,154,466 | 10/1964 | Nothum | 252/353 |
| 3,686,133 | 8/1972 | Hattori et al. | 252/353 |

*Primary Examiner*—Winston A. Douglas
*Assistant Examiner*—Y. Harris-Smith
*Attorney, Agent, or Firm*—Blanchard, Flynn, Thiel, Boutell & Tanis

[57] ABSTRACT

A mixed fuel of coal and fuel oil can be effectively stabilized by adding thereinto a compound obtained by the condensation reaction between a sulfonated aromatic compound having a hydrophobic group and formalin.

17 Claims, 1 Drawing Figure

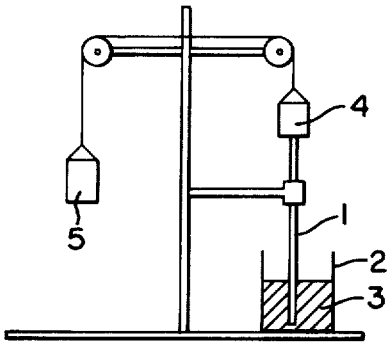
4
5
1
2
3

METHOD FOR STABILIZING A MIXED FUEL

BACKGROUND OF THE INVENTION

1. Field of the Invention

The present invention relates to a stabilizer for mixed fuels. More particularly, the invention relates to a stabilizer for mixed fuels, which is used as a dispersing stabilizer when fine particles of coal are dispersed in a fuel oil.

2. Description of the Prior Arts

During the First World War or Second World War, investigations were made on mixed fuels comprising coal and a fuel oil such as heavy oil or crude oil for military or other applications. Each of these investigations, however, was made mainly for compensating for the shortage of petroleum, and therefore, when the supply of petroleum was stabilized, working of these investigations was stopped. On transportation of coal, unloading of coal and shifting of coal after unloading are very troublesome operations. Accordingly, a coal-incorporated liquid fuel was conceived for the purpose of reducing the handling cost of coal. In France or USA, a hydraulic transportation system for transporting powdered coal hydraulically through a pipe line was established. This system for transportation of aqueous slurries of coal was investigated also in Japan. However, coal is transported in Japan by marine transportation, and in the case of marine transportation, the transportation cost is increased when excessive water is shipped. Further, in the case of an aqueous slurry of coal, the combustion efficiency is reduced. For these reasons, the above-mentioned hydraulic transportation system was not actually worked in Japan. However, based on a concept that the foregoing defects involved in an aqueous slurry of coal will be eliminated if a mixture of coal and a fuel oil such as heavy oil or crude oil is used instead of the above-mentioned aqueous slurry, such mixed fuel, namely a coal-oil mixture (hereinafter referred to as "COM"), has recently been reconsidered. Especially, since the so-called "oil shock", the price of petroleum has drastically risen and there is a possibility that the price of COM will be reduced below the price of heavy oil. Further, coal resources are ample. Under such background, investigations on practical utilization of COM has now been promoted. In Japan, coal must be imported from abroad, and hence, reduction of the handling cost will result in reduction of the price. Therefore, it is eagerly desired to put COM into practical use. COM has the following advantages:

(i) The calorific value is higher than that of coal, and the existing combustion apparatus for petroleum can be used for COM only with a partial modification.

(ii) Marine transportation by tankers is possible, and mass transportation of coal in the form of COM can be performed conveniently.

(iii) Long-distance land transportation (pipe transportation) is possible.

(iv) Spontaneous combustion of coal during transportation can be prevented, and it becomes possible to import brown coal, which has not been imported though it is cheap, because spontaneous combustion is readily caused in brown coal during transportation.

(v) Storage space can be reduced and the specific gravity is higher than that of water, and even if a fire occurs, fire extinguishing can easily be accomplished in the case of COM and a flow-out accident that frequently takes place in the case of crude oil does not occur at all.

(vi) Stable supply can be assured and a high economical merit can be attained.

(vii) A large wharf or other harbour equipment is necessary for landing in the case of marine transportation of coal and a large machine or other equipment is necessary for transportation of landed coal, but COM can be landed and transported quite in the same manner as petroleum is landed and transported.

In COM, coal particles as solids are precipitated in a fuel oil as the dispersion medium owing to the difference of the specific gravity, and the precipitation speed is influenced by the viscosity of the fuel oil and the size of the coal particles. As the size of the coal particles is finer, the precipitation speed is low. Accordingly, it is desired to pulverize coal as finely as possible. However, the volume of pulverized coal is increased as the particle size becomes fine. Powdered coal now used in a power plant has such a size that 80% of the particles can pass through a 200-mesh sieve, namely a particle size of about 74 microns. Accordingly, it is expected that powdered coal having such a particle size will be used as standard powdered coal. When a surface active agent is incorporated as a stabilizer into COM, the surface active agent is absorbed in the interface between coal particles and the fuel oil and it exerts functions of disintegrating agglomerates of coal particles and preventing cohesion of coal particles. In addition to these effects, an effect of converting coal particles precipitated in the lower layer to soft precipitates is required for the stabilizer (surface active agent) for COM. Namely, it is required that when COM is stored for a long time, in order to easily retain a homogeneous state in COM by agitation, the precipitated coal particles should be in the form of very soft precipitates. After preparation, COM passes through various processes such as pipe transportation, tanker transportation and tank storage until it is actually burnt as a fuel. Accordingly, in COM it is especially important that the precipitation speed of coal particles should be low and the precipitated coal particles should be dispersed again very easily. In coal-fuel mixtures, when no stabilizer is added, substantially all of the coal particles are precipitated if the mixtures are allowed to stand for about 1 or about 2 days after preparation, though the degree of precipitation differs to some extent in these mixtures, and the resulting precipitates are very hard and the re-dispersibility thereof is very low. Accordingly, when COM is to be stored for a long time after preparation, the role of the stabilizer is very important, and development of an excellent stabilizer is eagerly desired. Since COM passes through various processes such as mentioned above after preparation, it is required that COM should be stored for at least 4 to 7 days, preferably at least 15 to 30 days and should have a good re-dispersibility after standing.

Many patent applications have been filed as regards stabilizers for COM by Petrolite Co. and others, and the majority of commercially available surface active agents are described in specifications of these patent applications. However, each of these stabilizers is still insufficient in the stabilizing effect and development of a stabilizer having a higher effect has been desired in the art. As pointed out hereinbefore, the particle size of coal in COM is relatively large, and coal particles are precipitated if COM is stored for a long time. As means for retarding precipitation of coal particles, patent specifications of Petrolite Co. disclose methods in which certain additives are added to increase the viscosity of COM, especially to impart a thixotropic property to COM. Even if these methods are adopted, however, parts of the coal particles are precipitated to form hard precipitates, and the degree of rendering COM thixotropic should naturally be limited within a certain range. Further, if COM is rendered thixotropic, the viscosity is drastically elevated, and various troubles are caused in actual applications, such as difficult handling and the practical value of COM is extremely degraded.

SUMMARY OF THE INVENTION

As a result of our investigations made with a view to overcoming these defects involved in conventional stabilizers for COM, we have now completed the present invention.

More specifically, in accordance with the present invention, there is provided a stabilizer for a mixed fuel of coal and fuel oil, which comprises a compound represented by the following general formula:

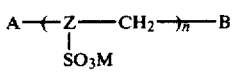

$$A-(Z(SO_3M)-CH_2)_n-B \quad (I)$$

wherein n is a number of from 1.2 to 30, M stands for a cation, Z stands for an aromatic residue having a saturated or unsaturated hydrocarbon group as a substituent, or said aromatic residue to which a substituent containing an atom other than carbon is bonded, A is H or $-CH_2OH$; and B is OH or $-ZHSO_3M$.

The stabilizer of the present invention represented by the general formula (I) consists of a product formed by sulfonating a compound having at least one aromatic ring and condensing the sulfonated compound with formalin and/or a salt of such product. The value (mean value) of n is in the range of from 1.2 to 30, preferably from 2.0 to 10. M stands for H or a cation such as $NH_4$, a lower amine, an alkali metal, e.g., Na or K, or an alkaline earth metal, e.g., Ca or Ba. It is especially preferred that M be H and that excess $H^+$ be present. Z stands for a residue of a compound having at least one aromatic ring. More specifically, Z stands for a residue of a compound having in the molecule as a substituent on the aromatic ring a hydrophobic group necessary for the stabilizer of the present invention represented by the general formula (I) to have an affinity or compatibility with a fuel oil. As such hydrophobic group, there can be mentioned saturated and unsaturated hydrocarbon groups, and an alkyl group having 1 to 20 carbon atoms and a naphthalene ring group are preferred as the hydrophobic group. As the aromatic residue, there can be mentioned residues of benzene, naphthalene, anthracene, phenanthrene, derivatives thereof and compounds having as a substituent —OH, $-NH_2$, —COOH, halogen or other functional group on such aromatic ring.

When the stabilizer of the present invention is incorporated in COM in an amount of 0.005 to 0.5% by weight, preferably 0.02 to 0.2% by weight, fine particles of coal can be stably dispersed in a fuel oil and the stabilizer exerts a function of converting coal particles precipitated in the lower layer to very soft precipitates that can easily be re-dispersed.

In COM, if the mixing ratio of coal (C) to a fuel oil (O), namely the C/O ratio (weight ratio), is too low, the significance of the preparation of COM is substantially lost, and if the C/O ratio is too high, the viscosity becomes too high. Accordingly, in general, the C/O ratio is adjusted to 10/90 to 70/30, preferably 40/60 to 55/45, though this ratio is changed to some extent depending on the kinds of coal and fuel oil to be combined. From the viewpoint of the transportation efficiency, it is preferred that the quantity of water contained in COM be as small as possible, but from the viewpoints of stability and re-dispersibility, it is preferred that water be contained in a certain amount in COM. In general, coal contains 2 to 6% by weight of water, and in some case, 20 to 40% of water is contained in coal. From the viewpoints of stability, re-dispersibility, transportation efficiency and other factors, the water content in COM is adjusted to 0 to 20% by weight, preferably 3 to 8% by weight, based on COM. As regards the order of addition of powdered coal, water and fuel oil, water may be first added to fuel oil and powdered coal may be than added to the mixture, but addition can be performed more effectively by adding water to powdered coal and then adding fuel oil to the mixture. The stabilizer of the present invention consisting of a compound represented by the above general formula (I) has an emulsifying activity but the main activity of the stabilizer of the present invention is a dispersing activity of forming soft precipitates (sediments) that can easily be re-dispersed.

The fuel oil that is used in the present invention includes all liquid fuels such as heavy oil and crude oil.

BRIEF DESCRIPTION OF THE DRAWING

The drawing is a schematic illustration of an apparatus for measuring the hardness of precipitates in COM.

In the drawing, reference number 1 indicates a stainless steel rod, 2 indicates a glass bottle, 3 indicates the COM and 4 and 5 indicate loads.

The present invention will now be described in detail by reference to the following Examples that by no means limit the scope of the invention.

EXAMPLE 1

A solution of a predetermined amount of a stabilizer in 16.85 g of water was added to 250.0 g of Vermont coal(1) pulverized so that 80% of particles could pass through a 200-mesh sieve, and the mixture was sufficiently stirred by a spatula to form a Vermont coal-water mixture having an appearance resembling that of slightly wet Vermont coal, and the appearance of the powder was hardly different from the appearance of the powder before addition of water. The resulting coal-water mixture was added to 250.0 g of Middle East heavy oil(2) containing a predetermined amount of a stabilizer dissolved therein and heated at about 75° C. and the mixture was allowed to stand in an oil bath maintained at 75° C. for 30 minutes. Then, the mixture was stirred for 5 minutes at 300 to 400 rpm by means of a laboratory mixer to prepare COM. The so formed COM was charged in a glass bottle (mayonnaise bottle) having an inner diameter a about 40 mm and a height of about 70 mm, and the bottle was sealed and stored in an oil bath maintained at 75° C. The hardness of the formed precipitate was measured at predetermined intervals by using an apparatus shown in the drawing. Namely, a stainless steel rod 1 having a diameter of 5 mm was attached, and the left and right portions were balanced with each other by adjusting loads 4 and 5, and after a predetermined time (1 day, 3 days, 7 days or 15 days) had passed from the preparation of the COM, the load necessary for the stainless steel rod 1 to arrive at the bottom of the glass bottle 3 filled with COM through the precipitate was measured and the measured load was used as a measure for determining the hardness of the precipitate.

The re-dispersibility of COM after 15 days' standing was evaluated based on the state observed when the upper liquid layer was stirred at 300 to 400 rpm for 10 minutes by means of a laboratory mixer. In the column "Redispersibility" of Table 1, "good" means that the state was similar to the state of COM just after preparation and the load necessary for the stainless steel rod to arrive at the bottle bottom was less than 5 g, and "bad" means that the load necessary for the stainless steel rod to arrive at the bottle bottom was more than 60 g, while "slightly good" indicates the state intermediate between "good" and "bad".

Obtained results are shown in Table 1.

Note (1) Vermont coal (produced in Australia):

High calorific value: 6550 Kcal/Kg (JIS M8814)
Ash content: 15.95% (JIS M8812L )
Water content: 3.25% (JIS 8811)
Fixed carbon content: 49.35% (JIS 8812)
Elementary analysis values (JIS M8813): C=16.17%, H=4.71%, N=1.23%, O=8.44%, S=0.50%, Cl=0.03%, Na=0.04%.

(2) Middle East heavy oil (produced in the Middle East):
Calorific value: 10310 Kcal/Kg (JIS K2265)
Specific gravity: 0.9576
Pour point: −2.5° C. (JIS K2269)
Ignition point: 94.0° C. (JIS K2265)
Ash content: 0.02% (JIS K2272)
Water content: 0.03% (JIS K2275)
Elementary analysis value (Yanagimoto Organic Automatic Elementary Analyzer): C=84.17%, H=13.06%, S=2.39%, N=0.25%, O=0.13%, Cl=3.3 ppm, V=65 ppm, Na=15 ppm.

Table 1

| Sample No. | Sample Stabilizer | Stabilizer-Dissolved Phase | Amount (% by Weight based on total composition) of Stabilizer | Load(g) Necessary for Test Rod to Arrive at Bottom of COM-Charged Bottle: after 1 day's standing | after 3 days' standing | after 7 days' standing | after 15 days' standing | Re-Dispersibility of COM after 15 Days' Standing |
|---|---|---|---|---|---|---|---|---|
| Comparative Samples | | | | | | | | |
| 1 | not added | | 0.00 | 16 | 37 | 130 | 140< | bad |
| | dodecyl benzene-sulfonate | oil | 0.10 | 12 | 34 | 126 | 140< | bad |
| 2 | " | oil | 0.30 | 12 | 33 | 120 | > | bad |
| | sodium dedecyl benzene-sulfonate | water | 0.10 | 17 | 39 | 140 | 140< | bad |
| 3 | " | water | 0.30 | 16 | 42 | 140< | 140< | bad |
| | calcium dodecyl benzene-sulfonate | oil | 0.10 | 16 | 32 | 119 | 140< | bad |
| 4 | " | oil | 0.30 | 16 | 31 | 115 | 140< | bad |
| | octyl benzene-sulfonate | oil | 0.10 | 12 | 35 | 121 | 140< | bad |
| 5 | " | oil | 0.30 | 10> | 32 | 116 | 140< | bad |
| | " | water | 0.10 | 17 | 36 | 129 | 140< | bad |
| | dodecyl naphthalene-sulfonate | oil | 0.10 | 10> | 26 | 95 | 125 | slightly bad |
| 6 | " | oil | 0.30 | 10 | 24 | 86 | 120 | " |
| | calcium dodecyl naphthalene-sulfonate | oil | 0.10 | 14 | 34 | 124 | 140< | bad |
| 7 | " | oil | 0.30 | 13 | 33 | 121 | 140< | bad |
| | butyl naphthalene-sulfonate | oil | 0.10 | 10> | 24 | 87 | 120 | slightly bad |
| 8 | " | oil | 0.30 | 10> | 22 | 80 | 112 | " |
| | sodium butyl naphthalene-sulfonate | water | 0.10 | 17 | 36 | 125 | 140< | " |
| 9 | " | water | 0.30 | 17 | 34 | 122 | 140< | " |
| | calcium butyl naphthalene-sulfonate | oil | 0.10 | 16 | 33 | 120 | 140< | " |
| 10 | " | oil | 0.30 | 15 | 30 | 115 | 140< | " |
| | lauric acid | oil | 0.10 | 15 | 32 | 114 | 140< | " |
| 11 | " | oil | 0.30 | 16 | 30 | 110 | 140< | " |
| | calcium laurate | oil | 0.10 | 17 | 34 | 119 | 140< | slightly bad |
| 12 | " | oil | 0.30 | 17 | 33 | 116 | 140< | " |
| | sodium petroleum-sulfonate (molecular weight = 450) | oil | 0.10 | 16 | 26 | 118 | 140< | " |
| 13 | " | oil | 0.30 | 15 | 24 | 116 | 140< | " |
| | nonylphenyl sulfonate | oil | 0.10 | 10> | 29 | 120 | 140< | " |
| 14 | " | oil | 0.30 | 10> | 27 | 116 | 140< | " |
| | calcium nonyl phenolate sulfide containing | oil | 0.10 | 10> | 22 | 106 | 140< | " |
| 15 | sulfur in an amount of 3% by weight per molecule | oil | 0.30 | 10> | 20 | 103 | 140< | " |
| | naphthalene-sulfonic acid-formalin | water | 0.10 | 17 | 30 | 104 | 140< | " |
| 16 | condensate (condensation degree = 3.5) | water | 0.30 | 17 | 28 | 100 | 140< | " |
| 17 | sodium naphthalene-sulfonate-formalin | water | 0.10 | 16 | 33 | 126 | 140< | bad |

Table 1-continued

| | | | | | | | | |
|---|---|---|---|---|---|---|---|---|
| | condensate (condensation degree = 3.5) | water | 0.30 | 16 | 30 | 118 | 140< | bad |
| | lignin-sulfonic acid | water | 0.10 | 10 | 29 | 119 | 140< | bad |
| 18 | " | water | 0.30 | 10 | 27 | 110 | 140< | bad |
| | sodium lignin-sulfonate | water | 0.10 | 16 | 34 | 124 | 140< | bad |
| 19 | " | water | 0.30 | 16 | 32 | 113 | 140< | bad |
| | POE(5 moles)-nonylphenyl ether | oil | 0.10 | 17 | 35 | 129 | 140< | bad |
| 20 | " | oil | 0.30 | 17 | 34 | 128 | 140< | bad |
| | POE(9 moles)-nonylphenyl ether | water | 0.10 | 17 | 33 | 128 | 140< | bad |
| 21 | " | water | 0.30 | 17 | 31 | 128 | 140< | bad |
| | sorbitan mono-oleate | oil | 0.10 | 16 | 32 | 124 | 140< | bad |
| 22 | " | oil | 0.30 | 16 | 30 | 122 | 140< | bad |
| | POE(15 moles)-sorbitan mono-oleate | water | 0.10 | 17 | 38 | 129 | 140< | bad |
| 23 | " | water | 0.30 | 17 | 35 | 128 | 140< | bad |
| | polyethylene glycol (molecular weight = 10000) | water | 0.10 | 17 | 39 | 130 | 140< | bad |
| 24 | " | water | 0.30 | 17 | 36 | 128 | 140< | bad |
| | oligosaccharide (hydrolyzed starch, molecular weight = 2000) | water | 0.10 | 16 | 37 | 136 | 140< | bad |
| 25 | " | water | 0.30 | 17 | 36 | 130 | 140< | bad |
| | octene-sodium maleate copolymer | water | 0.10 | 16 | 35 | 134 | 140< | bad |
| 26 | " | water | 0.30 | 16 | 32 | 131 | 140< | bad |
| | semi-amidation product of octene-maleic | oil | 0.10 | 12 | 28 | 123 | 140< | bad |
| 27 | anhydride copolymer with dodecyl amine | oil | 0.30 | 12 | 27 | 112 | 140< | bad |
| | lauric acid ester of | oil | 0.10 | 10> | 25 | 119 | 140< | bad |
| 28 | styrene-maleic anhydride copolymer | oil | 0.30 | 10> | 24 | 110 | 140< | bad |
| | sodium polyacrylate (molecular weight = 6000) | water | 0.10 | 17 | 38 | 131 | 140< | bad |
| 29 | " | water | 0.30 | 17 | 36 | 135 | 140< | bad |
| | petroleum-sulfonic acid (molecular weight = 450) | oil | 0.10 | 10> | 22 | 102 | 140< | slightly bad |
| 30 | " | oil | 0.30 | 10> | 20 | 96 | 140< | " |
| | tridecyl amine acetate | oil | 0.10 | 16 | 34 | 129 | 140< | bad |
| 31 | " | oil | 0.30 | 16 | 30 | 134 | 140< | bad |
| | lauryl propylene diamine | oil | 0.10 | 16 | 36 | 131 | 140< | bad |
| 32 | " | oil | 0.30 | 16 | 36 | 135 | 140< | bad |
| 33 | POE(4 moles)-lauryl propylene diamine | oil | 0.10 | 16 | 34 | 125 | 140< | bad |
| | | oil | 0.30 | 16 | 35 | 129 | 140< | bad |
| 34 | POE(4 moles)-lauryl amine | oil | 0.10 | 16 | 39 | 134 | 140< | bad |
| | | oil | 0.30 | 17 | 39 | 138 | 140< | bad |
| 35 | lauryltriethyl ammonium chloride | oil | 0.10 | 16 | 37 | 130 | 140< | bad |
| | | oil | 0.30 | 16 | 39 | 140 | 140< | bad |
| Samples of Present Invention | | | | | | | | |
| 36 | dodecyl benzene-sulfonate-formalin condensate (condensation degree = 3.0) | oil | 0.10 | 10> | 14 | 20 | 64 | good |
| | | oil | 0.30 | 10> | 10> | 15 | 52 | good |
| 37 | sodium dodecyl benzene-sulfonate-formalin condensate (condensation degree = 3.0) | water | 0.10 | 12 | 26 | 62 | 98 | slightly good |
| | | water | 0.30 | 10> | 24 | 62 | 90 | " |
| 38 | calcium dodecyl benzene-sulfonate formalin condensate (condensation degree = 3.0) | oil | 0.10 | 10> | 22 | 58 | 96 | slightly good |
| | | oil | 0.30 | 10> | 20 | 57 | 91 | " |
| 39 | octyl benzene-sulfonate formalin condensate (condensation degree = 3.5) | oil | 0.10 | 10> | 18 | 49 | 76 | good |
| | | oil | 0.30 | 10> | 18 | 45 | 73 | good |
| 40 | dodecyl naphthalene-sulfonate-formalin condensate (condensation degree = 2.6) | oil | 0.10 | 10> | 10> | 16 | 46 | good |
| | | oil | 0.30 | 10> | 10> | 15 | 40 | good |
| | calcium dodecyl | | | | | | | |

Table 1-continued

| | | | | | | | | |
|---|---|---|---|---|---|---|---|---|
| | naphthalene-sulfonate- | oil | 0.10 | 10> | 16 | 29 | 62 | good |
| 41 | formalin condensate | | | | | | | |
| | (condensation degree = 2.6) | oil | 0.30 | 10> | 17 | 21 | 63 | good |
| | sodium dodecyl naphthalene-sulfonate- | water | 0.10 | 10> | 27 | 57 | 90 | slightly good |
| 42 | formalin condensate | | | | | | | |
| | (condensation degree = 2.6) | water | 0.30 | 10> | 25 | 56 | 85 | " |
| 43 | hexyl naphthalene-sulfonate-formalin condensate (condensation degree = 1.3) | oil | 0.10 | 10> | 25 | 60 | 92 | slightly good |
| | | oil | 0.30 | 20> | 20 | 57 | 84 | " |
| 44 | hexyl naphthalene-sulfonate-formalin condensate (condensation degree = 2.1) | oil | 0.10 | 10> | 10> | 10> | 40 | good |
| | | oil | 0.30 | 10> | 10> | 10> | 33 | good |
| 45 | hexyl naphthalene-sulfonate-formalin condensate (condensation degree = 3.6) | oil | 0.10 | 10> | 10> | 10> | 37 | good |
| | | oil | 0.30 | 10> | 10> | 10> | 34 | good |
| 46 | hexyl naphthalene-sulfonate-formalin condensate (condensation degree = 5.2) | oil | 0.10 | 10> | 10> | 10> | 35 | good |
| | | oil | 0.30 | 10> | 10> | 10> | 31 | good |
| 47 | hexyl naphthalene-sulfonate-formalin condensate (condensation degree = 8.0) | oil | 0.10 | 10> | 10> | 10> | 36 | good |
| | | oil | 0.30 | 10> | 10> | 10> | 30 | good |
| 48 | propylnaphthalene-sulfonate-formalin condensate (condensation degree = 2.3) | oil | 0.10 | 10> | 10> | 10> | 37 | good |
| | | oil | 0.30 | 10> | 10> | 10> | 37 | good |
| 49 | petroleum-sulfonic acid (molecular weight = 450)-formalin condensate (condensation degree = 2.1) | oil | 0.10 | 10> | 10> | 10> | 32 | good |
| | | oil | 0.30 | 10> | 10> | 10> | 30 | good |
| 50 | sodium petroleum-sulfonate (molecular weight = 450)-formalin condensate (condensation degree = 2.1) | oil | 0.10 | 10> | 16 | 24 | 68 | good |
| | | oil | 0.30 | 10> | 13 | 21 | 62 | good |
| 51 | nonylphenyl sulfonate-formalin condensate (condensation degree = 3.5) | oil | 0.10 | 10> | 10> | 19 | 56 | good |
| | | oil | 0.30 | 10> | 10> | 18 | 52 | good |
| 52 | butylphenylsulfonate-formalin condensate (condensation degree = 3.1) | oil | 0.10 | 10> | 12 | 22 | 59 | good |
| | | oil | 0.30 | 10> | 10 | 20 | 51 | good |

Note
The amount of water contained in COM was 5% by weight based on the total composition.

EXAMPLE 2

A solution of a predetermined amount of a stabilizer in 25 g of water was added to 250.0 g (exclusive of water) of Daido coal(1) pulverized so that 80% of the particles could pass through a 200-mesh sieve and they were stirred sufficiently by a spatula to obtain a mixture of Daido coal and water. The coal-water mixture was added to 250.0 g of Minas heavy oil(2) containing a predetermined amount of a stabilizer dissolved therein and heated at about 75° C., and the mixture was allowed to stand in an oil bath maintained at 75° C. for 30 minutes and stirred at 300 to 400 rpm for 5 minutes by using a laboratory mixer to form COM. The so formed COM was filled in a glass bottle (mayonnaise bottle) having an inner diameter of about 40 mm and a height of about 70 mm, and the bottle was sealed and stored in an oil bath maintained at 75° C. In the same manner as described in Example 1, the hardness of the precipitate was measured at predetermined intervals, and the re-dispersibility of COM was determined after 15 days' standing. The evaluation was conducted in the same manner as described in Example 1. Obtained results are shown in Table 2.

Note (1) Daido coal (produced in China):
High calorific value: 7090 Kcal/Kg
Ash content: 12.14%
Water content: 2.58%
Fixed carbon content: 51.92%
Elementary analysis values (JIS M8813): C=72.74%, H=3.15%, N=8.83%, O=2.30%, S=0.67%, Na=0.04%, K=0.05%.

The measurement methods were the same as those described in Example 1.

(2) Minas heavy oil (produced in Indonesia):
Calorific value: 10960 Kcal/Kg
Ash content: 0.025%
Water content: below 0.1%
Specific gravity: 0.862 (70°/4° C.)
Pour point: 46.5° C.
Ignition point: 133° C.
Elementary analysis values: C=86.43%, H=12.83%, S=0.11%.

The measurement methods were the same as those described in Example 1.

Table 2

| Sample Stabilizer | Stabilizer Dissolved Phase | Amount (% by Weight based on total composition) of Stabilizer | Load (g) Necessary for Test Rod to Arrive at Bottom of COM-Charged Bottle | | | | Re-Dispersibility of COM after 15 Days' Standing |
|---|---|---|---|---|---|---|---|
| | | | after 1 day's standing | after 3 days' standing | after 7 days' standing | after 15 days' standing | |
| Comparative Samples | | | | | | | |
| not added | | 0.00 | 10> | 28 | 70 | 140< | bad |
| Sample No. 2 on | oil | 0.10 | 10> | 12 | 54 | 140< | bad |
| Table 1 | oil | 0.30 | 10> | 10> | 50 | 140< | bad |
| Sample No. 3 on | water | 0.10 | 10> | 24 | 68 | 140< | bad |
| Table 1 | water | 0.30 | 10> | 25 | 69 | 140< | bad |
| Sample No. 4 on | oil | 0.10 | 10> | 26 | 72 | 140< | bad |
| Table 1 | oil | 0.30 | 10> | 24 | 70 | 140< | bad |
| Sample No. 5 on | oil | 0.10 | 10> | 14 | 51 | 140< | bad |
| Table 1 | oil | 0.30 | 10> | 12 | 49 | 140< | bad |
| Sample No. 6 on | oil | 0.10 | 10> | 12 | 50 | 138 | bad |
| Table 1 | oil | 0.30 | 10> | 10 | 45 | 130 | bad |
| Sample No. 18 on | water | 0.10 | 10> | 29 | 69 | 140< | bad |
| Table 1 | water | 0.30 | 10> | 28 | 73 | 140< | bad |
| Samples of Present Invention | | | | | | | |
| Sample No. 36 on | oil | 0.10 | 10> | 10> | 21 | 85 | slightly good |
| Table | oil | 0.30 | 10> | 10> | 20 | 71 | good |
| Sample No. 37 on | water | 0.10 | 10> | 13 | 40 | 116 | slightly good |
| Table 1 | water | 0.30 | 10> | 11 | 38 | 110 | " |
| Sample No. 40 on | oil | 0.10 | 10> | 10> | 25 | 63 | good |
| Table 1 | oil | 0.30 | 10> | 10> | 22 | 58 | good |
| Sample No. 45 on | oil | 0.10 | 10> | 10> | 20 | 54 | good |
| Table 1 | oil | 0.30 | 10> | 10> | 18 | 51 | good |
| Sample No. 49 on | oil | 0.10 | 10> | 10> | 19 | 49 | good |
| Table 1 | oil | 0.30 | 10> | 10> | 18 | 47 | good |
| Sample No. 52 | oil | 0.10 | 10> | 10> | 30 | 73 | good |
| Table 1 | oil | 0.30 | 10> | 10> | 27 | 70 | good |

Note
Water was added so that the total content of water in COM was 5% by weight.

Table 3

| Sample Stabilizer | Amount (% by Weight based on total composition of Stabilizer | Load (g) Necessary for Test Rod to Arrive at Bottom of COM-Charged Bottle | | | | Re-Dispersibility of COM after 15 Days' standing |
|---|---|---|---|---|---|---|
| | | after 1 day's standing | after 3 days' standing | after 7 days' standing | after 15 days' standing | |
| Comparative Samples | | | | | | |
| not added | 0.00 | 16 | 37 | 130 | 140< | bad |
| Sample No. 2 on Table 1 | 0.01 | 17 | 36 | 134 | 140< | bad |
| " | 0.05 | 17 | 38 | 132 | 140< | bad |
| " | 0.10 | 12 | 34 | 126 | 140< | bad |
| " | 0.30 | 12 | 33 | 120 | 140< | bad |
| " | 0.50 | 10 | 28 | 112 | 140< | bad |
| Samples of Present Invention | | | | | | |
| Sample No. 40 on Table 1 | 0.01 | 14 | 23 | 89 | 136 | slightly bad |
| " | 0.05 | 10> | 12 | 31 | 63 | good |
| " | 0.10 | 10> | 10> | 16 | 46 | good |
| " | 0.30 | 10> | 10> | 15 | 40 | good |
| " | 0.50 | 10> | 10> | 10 | 35 | good |

Note
The content of water in COM was 5% by weight.

EXAMPLE 3

In the same manner as described in Example 1, COM was prepared by using Vermont coal as coal and Middle East heavy oil as oil, but the concentration of the stabilizer was changed in the range of 0.01 to 0.5% by weight. The test methods and evaluation methods were the same as those as described in Example 1. Obtained results are shown in Table 3.

EXAMPLE 4

In the same manner as described in Example 1, COM was prepared by using Vermont coal as coal and Middle East heavy oil as oil, but the content of water in COM was changed in the range of 0 to 20% by weight based on the total composition. The test methods and evaluation methods were the same as those described in Example 1. Obtained results are shown in Table 4.

Table 4

| Amount (% by weight based on total composition) of Water | Stabilizer | Amount (% by Weight based on total composition) of Stabilizer | Load (g) Necessary for Test Rod to Arrive at Bottom of COM-Charged Bottle | | | | Re-Dispersibility of COM after 15 Days' standing |
|---|---|---|---|---|---|---|---|
| | | | after 1 day's standing | after 3 days' standing | after 7 days' standing | after 15 days' standing | |
| 0 | not added | 0.00 | 24 | 86 | 140< | 140< | bad |
| 5 | " | 0.00 | 16 | 37 | 130 | 140< | bad |
| 10 | " | 0.00 | 13 | 30 | 124 | 140< | bad |
| 20 | " | 0.00 | 10 | 28 | 116 | 140< | bad |
| 0 | Sample No. 40 on Table 1 | 0.10 | 10> | 30 | 65 | 130 | slightly good |
| 5 | " | 0.10 | 10> | 10> | 16 | 46 | good |
| 10 | " | 0.10 | 10> | 10> | 14 | 40 | good |
| 20 | " | 0.10 | 10> | 10> | 14 | 33 | good |

The embodiments of the invention in which an exclusive property or privilege is claimed are defined as follows:

1. A method for stabilizing a mixed fuel of coal and fuel oil which comprises: admixing with said mixed fuel a stabilizing amount of a compound having the formula:

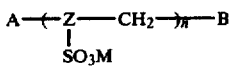

(I)

wherein n is a number of from 1.2 to 30; M is a cation; Z is a substituted aromatic radical having a saturated or unsaturated hydrocarbon hydrophobic group as a first substituent, said aromatic radical optionally having a second substituent containing an atom other than carbon; A is H or —$CH_2OH$; and B is OH or —$ZHSO_3M$.

2. A method as set forth in claim 1 wherein the aromatic radical has 1 to 3 rings.

3. A method as set forth in claim 2 wherein the aromatic radical is a naphthalene radical.

4. A method as set forth in claim 1 wherein the cation is a monovalent or divalent cation.

5. A method as set forth in claim 4 wherein said cation is H, $NH_4$, a lower alkyl amine, an alkali metal or an alkaline earth metal.

6. A method as set forth in claim 4, wherein said cation is hydrogen or an alkali metal.

7. A method as set forth in claim 1 wherein said hydrocarbon hydrophobic group is an alkyl group having 1 to 20 carbon atoms or a naphthalene ring.

8. A method as set forth in claim 1 wherein n is a number of from 2.0 to 10 on the average.

9. A method as set forth in claim 1 wherein the compound of the formula (I) is added to a mixed fuel of coal and fuel oil in an amount of from 0.005 to 0.5 percent by weight based on the weight of said mixed fuel.

10. A method as set forth in claim 1 wherein said mixed fuel has a weight ratio of coal to oil in the range between 10:90 and 70:30.

11. A method as set forth in claim 1 wherein said mixed fuel contains up to 20 percent by weight of water based on the weight of said mixed fuel.

12. A method as set forth in claim 11 wherein water is first added to coal and then the mixture is added to fuel oil.

13. A mixed fuel consisting essentially of a mixture of coal and fuel oil mixed in a weight ratio of coal:fuel oil in the range of from 10:90 to 70:30, said mixture containing from 0.005 to 0.5 percent by weight, based on the combined weights of said coal and fuel oil, of a stabilizer having the formula

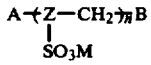

wherein n is a number of from 1.2 to 30; M is a cation; Z is a substituted aromatic radical having a saturated or unsaturated hydrocarbon hydrophobic group as a first substituent, said aromatic radical optionally having a second substituent containing an atom other than carbon; A is H or —$CH_2OH$; B is OH or —$ZHSO_3M$; said mixture containing up to 20 percent by weight of water, based on the combined weights of said coal and fuel oil.

14. A mixed fuel as claimed in claim 13 in which the amount of said stabilizer is from 0.02 to 0.2 percent by weight, based on the combined weights of said coal and fuel oil.

15. A mixed fuel as claimed in claim 14 in which the weight ratio of coal:fuel oil is in the range of from 40:60 to 55:45.

16. A mixed fuel as claimed in claim 15 containing from 3 to 8 percent by weight of water based on the combined weights of said coal and fuel oil.

17. A mixed fuel as claimed in claim 13 in which said aromatic radical is a benzene, naphthalene, anthracene or phenanthrene radical; said hydrocarbon hydrophobic group is alkyl having 1 to 20 carbon atoms or a naphthalene group; M is H, $NH_4$, lower amine, Na, K, Ca or Ba; n is from 2.0 to 10; and said optional second substituent is —OH, —$NH_2$, —COOH or halogen.

* * * * *